US010468820B1

(12) United States Patent
Ito

(10) Patent No.: US 10,468,820 B1
(45) Date of Patent: Nov. 5, 2019

(54) LOCKING ELECTRICAL OUTLET ASSEMBLY

(71) Applicant: Jeremy Ito, Encinitas, CA (US)

(72) Inventor: Jeremy Ito, Encinitas, CA (US)

( * ) Notice: Subject to any disclaimer, the term of this patent is extended or adjusted under 35 U.S.C. 154(b) by 0 days.

(21) Appl. No.: 16/177,997

(22) Filed: Nov. 1, 2018

(51) Int. Cl.
*H01R 13/639* (2006.01)
*H01R 25/00* (2006.01)

(52) U.S. Cl.
CPC ..... *H01R 13/6395* (2013.01); *H01R 25/006* (2013.01)

(58) Field of Classification Search
CPC ..... H01R 13/6395; H01R 125/006
USPC ..... 439/341
See application file for complete search history.

(56) References Cited

U.S. PATENT DOCUMENTS 2,872,654 A 2/1959 Smith
3,263,037 A 7/1966 Correnti
3,942,856 A 3/1976 Mindheim
3,990,758 A 11/1976 Petterson
4,037,901 A * 7/1977 Kaszuba ..... H01R 13/4532 439/138
4,185,881 A * 1/1980 Foley ..... H01R 13/4532 439/188
5,551,884 A * 9/1996 Burkhart, Sr. ..... H01R 13/20 439/140
D571,730 S 6/2008 Kidman
8,986,040 B2 3/2015 Garofalo
2013/0224984 A1* 8/2013 Gordon ..... H01R 13/6278 439/346

* cited by examiner

*Primary Examiner* — Tho D Ta
*Assistant Examiner* — Nader J Alhawamdeh

(57) ABSTRACT

A locking electrical outlet assembly includes at least one electrical plug that has a pair of blades and an outlet housing is provided that is positioned in a wall. A pair of sockets is each rotatably positioned in the outlet housing. Each of the sockets is rotatable between a first position and a second position, and each of the sockets is biased to rotate into the second position. A pair of locking units is each movably coupled to a respective one of the sockets for releasably retaining the sockets in the first position. Each of the locking units in the respective socket disengages the outlet housing when the electrical plug is plugged into the respective socket. A plurality of contacts is coupled to the outlet housing and each of the terminals on the sockets engages respective ones of the contacts when the sockets are rotated into a second position.

10 Claims, 4 Drawing Sheets

FIG. 3
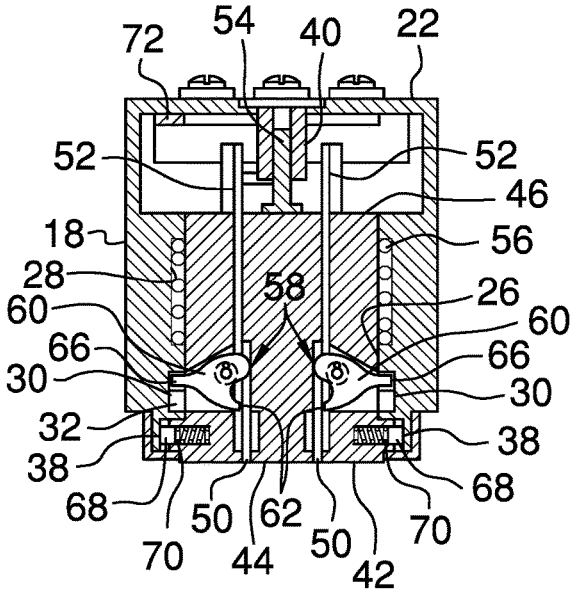
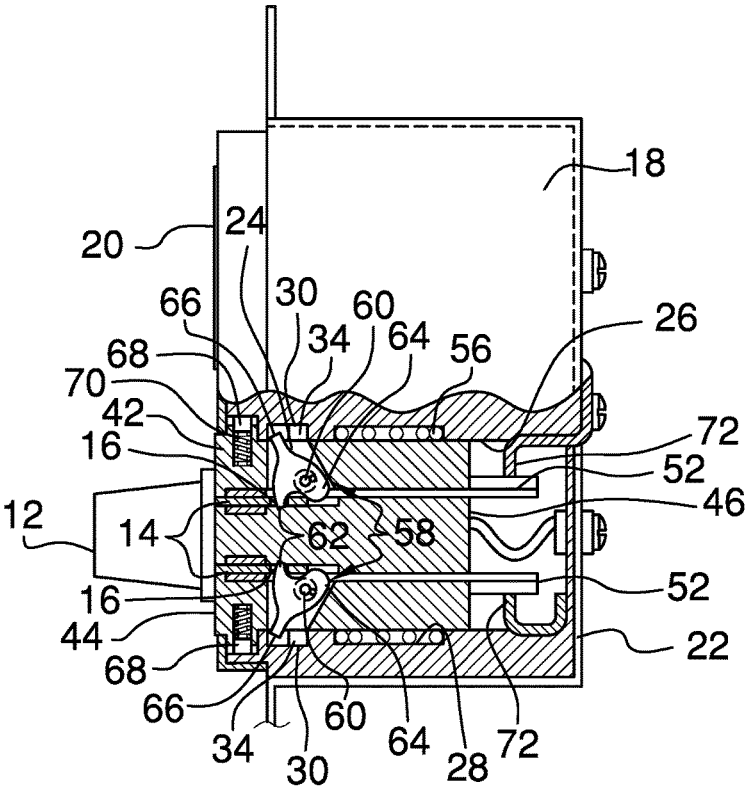
FIG. 4

LOCKING ELECTRICAL OUTLET ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to outlet devices and more particularly pertains to a new outlet device for PURPOSE.

BRIEF SUMMARY OF THE INVENTION

An embodiment of the disclosure meets the needs presented above by generally comprising at least one electrical plug that has a pair of blades and an outlet housing is provided that is positioned in a wall. A pair of sockets is each rotatably positioned in the outlet housing. Each of the sockets is rotatable between a first position and a second position, and each of the sockets is biased to rotate into the second position. A pair of locking units is each movably coupled to a respective one of the sockets for releasably retaining the sockets in the first position. Each of the locking units in the respective socket disengages the outlet housing when the electrical plug is plugged into the respective socket. A plurality of contacts is coupled to the outlet housing and each of the terminals on the sockets engages respective ones of the contacts when the sockets are rotated into a second position.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein:

FIG. 3 is a cross sectional view taken along line 3-3 of FIG. 1 of an embodiment of the disclosure.

FIG. 4 is a left side cut-away view of an embodiment of the disclosure.

DETAILED DESCRIPTION OF THE INVENTION

Figure 1:
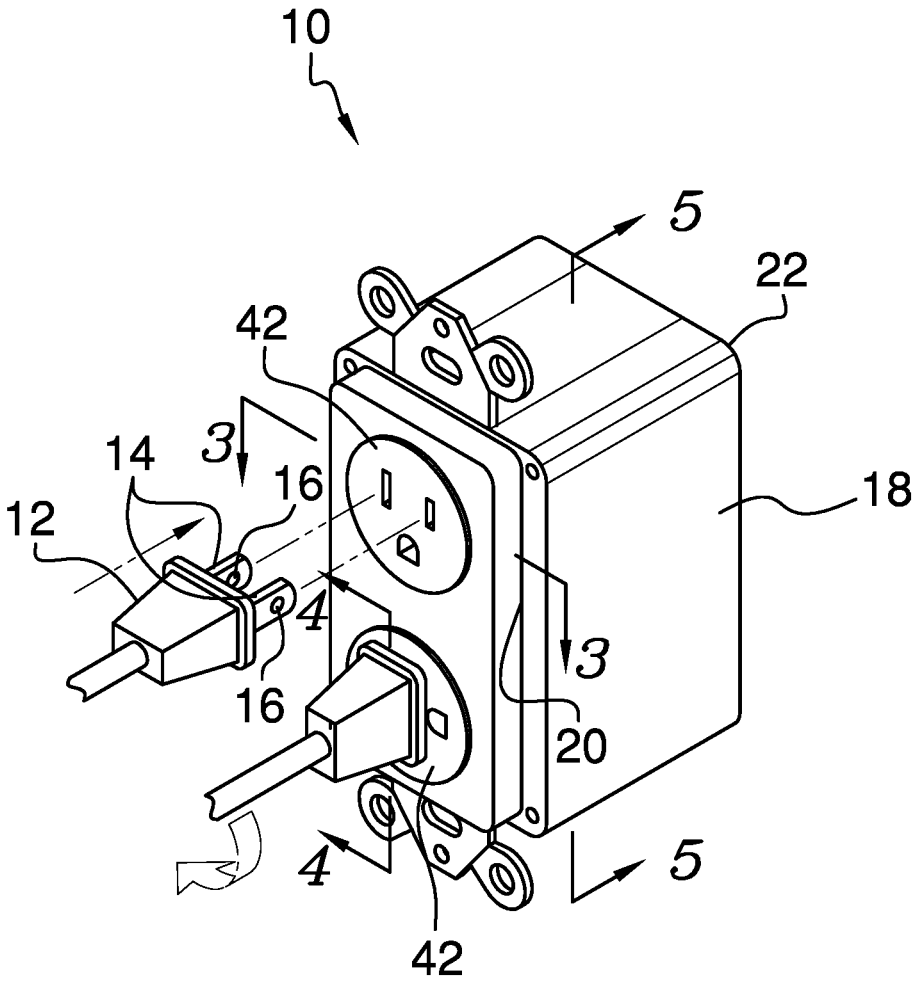
FIG. 1 is a front perspective view of a locking electrical outlet assembly according to an embodiment of the disclosure.
Figure 2:
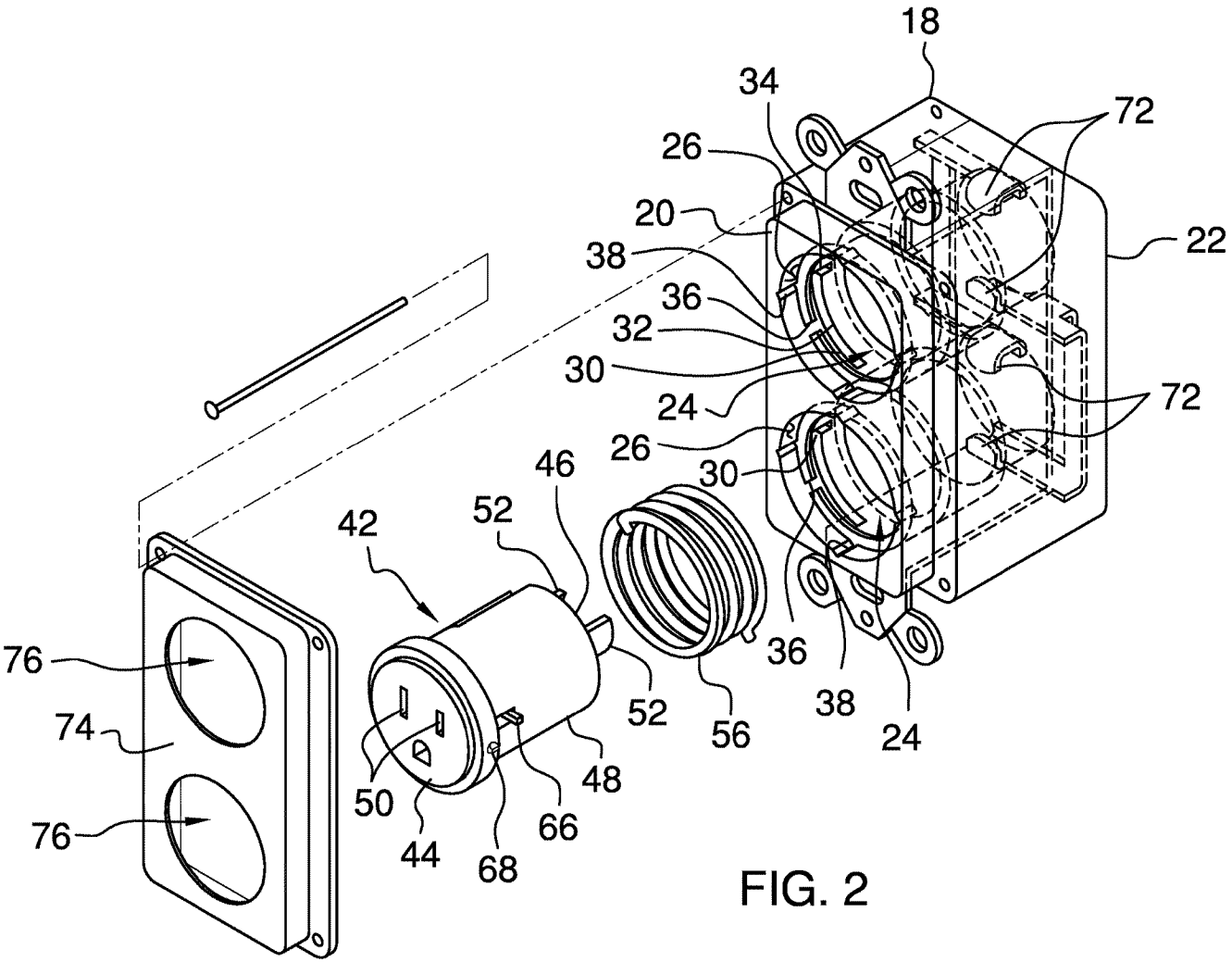
FIG. 2 is an exploded phantom view of an embodiment of the disclosure.
Figure 5:
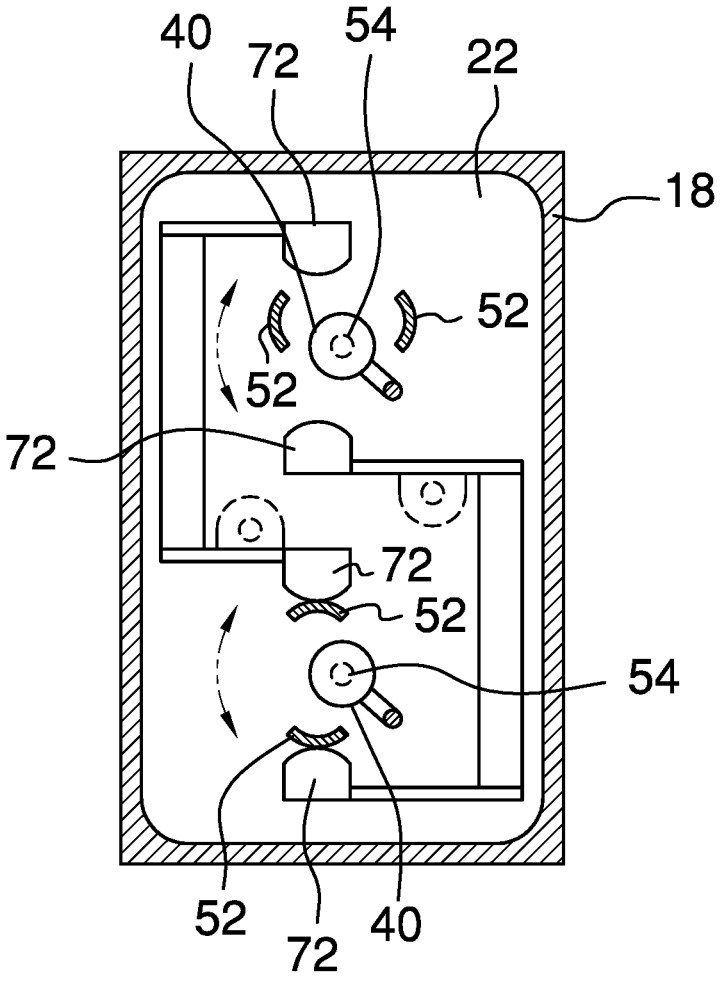
FIG. 5 is a cross sectional view taken along line 5-5 of FIG. 1 of an embodiment of the disclosure.

With reference now to the drawings, and in particular to FIGS. 1 through 5 thereof, a new outlet device embodying the principles and concepts of an embodiment of the disclosure and generally designated by the reference numeral 10 will be described.

As best illustrated in FIGS. 1 through 5, the locking electrical outlet assembly 10 generally comprises at least one electrical plug 12 that has a pair of blades 14, and each of the blades 14 has an aperture 16 extending therethrough. The electrical plug 12 may be a male electrical plug of any conventional design such as would be found on electrical appliances, such as power tools, electronic devices and any other electrical device needing AC voltage to operate. An outlet housing 18 is provided and the outlet housing 18 is positioned in a wall. The outlet housing 18 may be constructed in accordance with National Electrical Code adopted in the United States.

The outlet housing 18 has a front wall 20 and a back wall 22, and the front wall 20 has a pair of wells 24 each extending toward the back wall 22. Each of the wells 24 has a bounding surface 26 and the bounding surface 26 of each of the wells 24 has a spring recess 28 therein. The spring recess 28 extends around a full circumference of the bounding surface 26 and the spring recess 28 is spaced from the front wall 20 of the outlet housing 18.

The bounding surface 26 of each of the wells 24 has a pair of channels 30 therein and each of the channels 30 in each of the wells 24 extends partially around the circumference of the bounding surface 26. Each of the channels 30 has a first portion 32 that is oriented perpendicular to a second portion 34. The bounding surface 26 of each of the wells 24 has a pair of notches 36 extending between the front wall 20 of the outlet housing 18 and intersecting a respective one of the channels 30. Additionally, the bounding surface 26 of each of the wells 24 has a plurality of detents 38 therein. Each of the detents 38 in each of the wells 24 intersects the front wall 20 of the outlet housing 18.

A pair of ground receivers 40 is provided and each of the ground receivers 40 is coupled to the back wall 22 of the outlet housing 18. Each of the ground receivers 40 is electrically coupled to a ground circuit such as is commonly found in residential and commercial structures in the United States. A pair of sockets 42 is provided and each of the sockets 42 is rotatably positioned in a respective one of the wells 24 in the front wall 20 of the outlet housing 18. Each of the sockets 42 is rotatable between a first position and a second position, and each of the sockets 42 is biased to rotate into the second position.

Each of the sockets 42 has a front end 44, a back end 46 and an outer wall 48 extending therebetween, and the outer wall 48 of each of the sockets 42 is continuously arcuate such that each of the sockets 42 has a cylindrical shape. The front end 44 of each of the sockets 42 has a plurality of slots 50 extending toward the back end 46. Moreover, the slots 50 in a respective one of the sockets 42 insertably receives a respective one of the blades 14 on the electrical plug 12 when the electrical plug 12 is plugged into the respective socket 42. Each of the sockets 42 has a pair of terminals 52 thereon and each of the terminals 52 is in electrical communication with a respective one of the blades 14 when the electrical at least one electrical plug 12 is plugged into the respective socket 42.

A plurality of ground posts 54 is each coupled to and extends away from the back end 46 of a respective one of the sockets 42. The ground post 54 on the respective socket 42 rotatably engages a respective one of the ground receivers 40 when the respective socket 42 is positioned in the respective well 24. In this way the respective socket 42 is in electrical communication with the ground circuit. Each of the ground posts 54 and the ground receivers 40 are comprised of an electrically conductive material. A pair of torsion springs 56 is provided and each of the torsion springs 56 is positioned in the spring recess 28 in a respective one of the wells 24. Each of the torsion springs 56 engages the socket positioned in the respective well 24 for biasing the socket 24 in the respective well 24 into the second position.

A pair of locking units 58 is each movably coupled to a respective one of the sockets 42. Each of the locking units 58 in the respective socket 42 releasably engages the blades 14 on the electrical plug 12 when the electrical plug 12 is plugged into the respective socket 42. Moreover, each of the locking units 58 in each of the sockets 42 releasably engages the outlet housing 18 when the sockets 42 are positioned in the first position to retain the sockets 42 in the first position. Each of the locking units 58 in the respective socket 42 disengages the outlet housing 18 when the electrical plug 12 is plugged into the respective socket 42 thereby facilitating the respective socket 42 to be biased into the second position.

Each of the locking units 58 comprises a pair of cams 60 and each of the cams 60 is rotatably positioned in the respective socket 42. Each of the cams 60 rotates in a locking position and an unlocking position, and each of the cams 60 is biased to rotate in the unlocking position. Each of the cams 60 has a finger 62, a lobe 64 and a foot 66 thereon. The foot 66 on each of the cams 60 extends outwardly through the outer wall 48 of the respective socket 42 when the respective cam 60 is biased to rotate in the locking position. Moreover, the foot 66 on each of the cams 60 passes through a respective one notches 36 in a respective one of the wells 24 and passes into a respective one of the channels 30 in the respective well 24 when the respective socket 42 is inserted into the respective well 24.

The foot 66 on each of the cams 60 travels along the first portion 32 of the respective channel and engages the second portion 34 of the respective channel when the respective socket 42 is rotated into the locking position in the respective well 24. In this way the cams 60 retains the respective socket 42 in the first position. Each of the cams 60 is aligned with a respective one of the slots 50 in the respective socket 42 having the lobe 64 on each of the cams 60 being positioned in the respective slot in the respective socket 42 when the cams 60 are in the locking position. The respective blade engages the lobe 64 on the respective cam 60 when the respective blade is inserted into the respective slot in the respective socket 42 thereby rotating the respective cam 60 into the unlocking position. Thus, the foot 66 on the respective cam 60 disengages the channel thereby facilitating the respective socket 42 to be biased to rotate into the second position.

The finger 62 on the respective cam 60 engages the aperture 16 in the respective blade when the respective blade engages the lobe 64 on the respective cam 60. Thus, the finger 62 on the respective cam 60 inhibits the respective blade from being removed from the socket. Moreover, the finger 62 on the respective cam 60 disengages the aperture 16 in the respective blade when the respective cam 60 is biased to rotate into the locking position. In this way the respective cam 60 facilitates the respective blade to be removed from the selected slot.

A pair of engagements 68 is each movably coupled to the outer wall 48 of the respective socket 42. Each of the engagements 68 releasably engages a respective one of the detents 38 in the respective well 24 when the respective socket 42 is rotated between the first and second positions. A pair of biasing members 70 is each coupled to the outer wall 48 of the respective socket 42 and biases a respective one of the engagements 68 outwardly from the respective socket 42 for releasably engaging the detents 38. Each of the engagements 68 facilitates the respective socket 42 to be positively engaged in the first or second positions.

A plurality of contacts 72 is each coupled to the outlet housing 18. Each of the contacts 72 is electrically coupled to a respective one of a voltage line and a neutral line. Each of the contacts 72 is coupled to the back wall 22 of the outlet housing 18 having the contacts 72 being positioned within the outlet housing 18. Moreover, each of the contacts 72 is aligned with a respective one of the wells 24 in the outlet housing 18 and each of the terminals 52 on the sockets 42 engages respective ones of the contacts 72 when the sockets 42 are rotated into the second position. In this way the electrical plug 12 is placed in electrical communication with the voltage line and the neutral line. Each of the terminals 52 on the sockets 42 disengages the respective contacts 72 when the sockets 42 are rotated into the first position.

A face plate 74 is removably coupled to the outlet housing 18 and the face plate 74 has a pair of openings 76 therein. Each of the openings 76 is aligned with a respective one of the wells 24 in the outlet housing 18 when the face plate 74 is removably coupled to the front wall 20 of the outlet housing 18. The face plate 74 may be fastened to the outlet housing 18 with fasteners, such as screws or the like.

In use, the blades 14 on the electrical plug 12 are inserted into the slots 50 in a selected one of said sockets 42. The blades 14 engage the lobe 64 on the cams 60 associated with the selected socket 42 thereby urging the cams 60 into the unlocking position. Thus, the selected socket 42 is biased to rotate into the second direction thereby placing the terminals 52 on the selected socket 42 into electrical communication with the respective contacts 72. In this way the electrical plug 12 is placed into electrical communication with the voltage line and the neutral line.

The finger 62 on each of the cams 60 engages the blades 14 when the electrical plug 12 is inserted into the slots 50. In this way the electrical plug 12 is inhibited from being unplugged from the socket 42 while the electrical plug 12 is in electrical communication with the voltage line and the neutral line. Thus, the electrical plug 12 cannot pose an electrocution risk to a child or the like. The electrical plug 12 is gripped and the selected socket 42 is rotated into the first position to facilitate the electrical plug 12 to be unplugged from the selected socket 42. Each of the cams 60 is biased to rotate into the locking position when the electrical plug 12 is unplugged from the selected socket. Thus, the foot 66 on each of the cams 60 engages the outlet housing 18 thereby retaining the selected socket 42 in the first position.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A locking electrical outlet assembly being configured to lock an electrical plug therein when the electrical plug is plugged into said assembly, said assembly comprising: at least one electrical plug having a pair of blades, each of said blades having an aperture extending therethrough; an outlet housing being positioned in a wall, said outlet housing having a plurality of wells therein; a pair of sockets, each of said sockets being rotatably positioned in a respective one of said wells in said front wall of said outlet housing, each of said sockets being rotatable between a first position and a second position, each of said sockets being biased to rotate into said second position; a pair of locking units, each of said locking units being movably coupled to a respective one of said sockets, each of said locking units in said respective socket releasably engaging said blades on said electrical plug when said electrical plug is plugged into said respective socket, each of said locking units in each of said sockets releasably engaging said outlet housing when said sockets are positioned in said first position to retain said sockets in said first position, each of said locking units in said respective socket disengaging said outlet housing when said electrical plug is plugged into said respective socket thereby facilitating said respective socket to be biased into said second position; a plurality of contacts, each of said contacts being coupled to said outlet housing, each of said contacts being configured to be electrically coupled to a respective one of a voltage line and a neutral line, each of said contacts being aligned with a respective one of said wells in said outlet housing, each of terminals on said sockets engaging respective ones of said contacts when said sockets are rotated into said second position wherein said electrical plug is configured to be placed in electrical communication with the voltage line and the neutral line, each of said terminals on said sockets disengaging said respective contacts when said sockets are rotated into said first position.

2. The assembly according to claim 1, wherein:

said outlet housing has a front wall and a back wall, each of said wells extending through said front wall toward said back wall, each of said wells having a bounding surface;

said bounding surface of each of said wells having a spring recess therein, said spring recess extending around a full circumference of said bounding surface, said spring recess being spaced from said front wall of said outlet housing;

said bounding surface of each of said wells having a pair of channels therein, each of said channels in each of said wells extending partially around said circumference of said bounding surface, each of said channels having a first portion being oriented perpendicular to a second portion;

said bounding surface of each of said wells having a pair of notches extending between said front wall of said outlet housing and intersecting a respective one of said channels; and said bounding surface of each of said wells having a plurality of detents therein, each of said detents in each of said wells intersecting said front wall of said outlet housing.

3. The assembly according to claim 2, wherein each of said sockets has a front end, a back end and an outer wall extending therebetween said outer wall of each of said sockets being continuously arcuate such that each of said sockets has a cylindrical shape, said front end of each of said sockets having a plurality of slots extending toward said back end, said slots in a respective one of said sockets insertably receiving a respective one of said blades on said electrical plug when said electrical plug is plugged into said respective socket, each of said sockets having a pair of terminals thereon, each of said terminals being in electrical communication with a respective one of said blades when said electrical at least one electrical plug is plugged into said respective socket.

4. The assembly according to claim 3, further comprising a pair of torsion springs, each of said torsion springs being positioned in said spring recess in a respective one of said wells, each of said torsion springs engaging said socket positioned in said respective well for biasing said socket in said respective well into said second position.

5. The assembly according to claim 3, wherein each of said locking unit comprises a pair of cams each of said cams being rotatably positioned in said respective socket, each of said cams rotating in a locking position and an unlocking position, each of said cams being biased to rotate in said unlocking position, each of said cams having a finger, a lobe and a foot thereon.

6. The assembly according to claim 5, wherein said foot on each of said cams extends outwardly through said outer wall of said respective socket when said respective cam is biased to rotate in said locking position, said foot on each of said cams passing through a respective one notches in a respective one of said wells and passing into a respective one of said channels in said respective well when said respective socket is inserted into said respective well, said foot on each of said cams travelling along said first portion of said respective channel and engaging said second portion of said respective channel when said respective socket is rotated into said locking position in said respective well for retaining said respective socket in said first position.

7. The assembly according to claim 6, wherein each of said cams is aligned with a respective one of said slots in said respective socket having said lobe on each of said cams being positioned in said respective slot in said respective socket when said cams are in said locking position, said respective blade engaging said lobe on said respective cam when said respective blade is inserted into said respective slot in said respective socket thereby rotating said respective cam into said unlocking position such that said foot on said respective cam disengages said channel thereby facilitating said respective socket to be biased to rotate into said second position.

8. The assembly according to claim 7, wherein said finger on said respective cam engages said aperture in said respective blade when said respective blade engages said lobe on said respective cam such that said finger on said respective cam inhibits said respective blade from being removed from said socket, said finger on said respective cam disengaging said aperture in said respective blade when said respective cam is biased to rotate into said locking position thereby facilitating said respective blade to be removed from said selected slot.

9. The assembly according to claim 2, further comprising:

a pair of engagements, each of said engagements being movably coupled to said outer wall of said respective socket, each of said engagements releasably engaging a respective one of said detents in said respective well when said respective socket is rotated between said first and second positions; and a pair of biasing members, each of said biasing members being coupled to said outer wall of said respective socket and engaging a respective on of said engagements outwardly from said respective socket for releasably engaging said detents.

10. A locking electrical outlet assembly being configured to lock an electrical plug therein when the electrical plug is plugged into said assembly, said assembly comprising:

at least one electrical plug having a pair of blades, each of said blades having an aperture extending therethrough;

an outlet housing being positioned in a wall, said outlet housing having a front wall and a back wall, said front wall having a pair of wells each extending toward said back wall, each of said wells having a bounding surface, said bounding surface of each of said wells having a spring recess therein, said spring recess extending around a full circumference of said bounding surface, said spring recess being spaced from said front wall of said outlet housing, said bounding surface of each of said wells having a pair of channels therein, each of said channels in each of said wells extending partially around said circumference of said bounding surface, each of said channels having a first portion being oriented perpendicular to a second portion, said bounding surface of each of said wells having a pair of notches extending between said front wall of said outlet housing and intersecting a respective one of said channels, said bounding surface of each of said wells having a plurality of detents therein, each of said detents in each of said wells intersecting said front wall of said outlet housing;

a pair of ground receivers, each of said ground receivers being coupled to said back wall of said outlet housing, each of said ground receivers being configured to be electrically coupled to a ground circuit;

a pair of sockets, each of said sockets being rotatably positioned in a respective one of said wells in said front wall of said outlet housing, each of said sockets being rotatable between a first position and a second position, each of said sockets being biased to rotate into said second position, each of said sockets having a front end, a back end and an outer wall extending therebetween said outer wall of each of said sockets being continuously arcuate such that each of said sockets has a cylindrical shape, said front end of each of said sockets having a plurality of slots extending toward said back end, said slots in a respective one of said sockets insertably receiving a respective one of said blades on said electrical plug when said electrical plug is plugged into said respective socket, each of said sockets having a pair of terminals thereon, each of said terminals being in electrical communication with a respective one of said blades when said electrical at least one electrical plug is plugged into said respective socket;

a plurality of ground posts, each of said ground posts being coupled to and extending away from a rear side of a respective one of said sockets, said ground post on said respective socket rotatably engaging a respective one of said ground receivers when said respective socket is positioned in said respective well wherein said respective socket is configured to be in electrical communication with the ground circuit;

a pair of torsion springs, each of said torsion springs being positioned in said spring recess in a respective one of said wells, each of said torsion springs engaging said socket positioned in said respective well for biasing said socket in said respective well into said second position;

a pair of locking units, each of said locking units being movably coupled to a respective one of said sockets, each of said locking units in said respective socket releasably engaging said blades on said electrical plug when said electrical plug is plugged into said respective socket, each of said locking units in each of said sockets releasably engaging said outlet housing when said sockets are positioned in said first position to retain said sockets in said first position, each of said locking units in said respective socket disengaging said outlet housing when said electrical plug is plugged into said respective socket thereby facilitating said respective socket to be biased into said second position, each of said locking unit comprising:

a pair of cams, each of said cams being rotatably positioned in said respective socket, each of said cams rotating in a locking position and an unlocking position, each of said cams being biased to rotate in said unlocking position, each of said cams having a finger, a lobe and a foot thereon, said foot on each of said cams extending outwardly through said outer wall of said respective socket when said respective cam is biased to rotate in said locking position, said foot on each of said cams passing through a respective one notches in a respective one of said wells and passing into a respective one of said channels in said respective well when said respective socket is inserted into said respective well, said foot on each of said cams travelling along said first portion of said respective channel and engaging said second portion of said respective channel when said respective socket is rotated into said locking position in said respective well for retaining said respective socket in said first position, each of said cams being aligned with a respective one of said slots in said respective socket having said lobe on each of said cams being positioned in said respective slot in said respective socket when said cams are in said locking position, said respective blade engaging said lobe on said respective cam when said respective blade is inserted into said respective slot in said respective socket thereby rotating said respective cam into said unlocking position such that said foot on said respective cam disengages said channel thereby facilitating said respective socket to be biased to rotate into said second position, said finger on said respective cam engaging said aperture in said respective blade when said respective blade engages said lobe on said respective cam such that said finger on said respective cam inhibits said respective blade from being removed from said socket, said finger on said respective cam disengaging said aperture in said respective blade when said respective cam is biased to rotate into said locking position thereby facilitating said respective blade to be removed from said selected slot;

a pair of engagements, each of said engagements being movably coupled to said outer wall of said respective socket, each of said engagements releasably engaging a respective one of said detents in said respective well when said respective socket is rotated between said first and second positions; and a pair of biasing members, each of said biasing members being coupled to said outer wall of said respective socket and engaging a respective on of said engagements outwardly from said respective socket for releasably engaging said detents;

a plurality of contacts, each of said contacts being coupled to said outlet housing, each of said contacts being configured to be electrically coupled to a respective one of a voltage line and a neutral line, each of said contacts being coupled to said back wall of said outlet housing having said contacts being positioned within said outlet housing, each of said contacts being aligned with a respective one of said wells in said outlet housing, each of said terminals on said sockets engaging respective ones of said contacts when said sockets are rotated into said second position wherein said electrical plug is configured to be placed in electrical communication with the voltage line and the neutral line, each of said terminals on said sockets disengaging said respective contacts when said sockets are rotated into said first position; and a face plate being removably coupled to said outlet housing, said face plate having a pair of openings therein, each of said openings being aligned with a respective one of said wells in said outlet housing when said face plate is removably coupled to said front wall of said outlet housing.

* * * * *